US005217177A

United States Patent [19]

Stefanoni

[11] Patent Number: 5,217,177

[45] Date of Patent: Jun. 8, 1993

[54] MACHINE WITH CONTINUOUS OPERATING CYCLE FOR THE PACKAGING IN ROLLS OF VARIOUS STRIP-SHAPED MATERIALS BY MEANS OF A PLURALITY OF SIMULTANEOUS LONGITUDINAL CUTS OF A WIDE STRIP OF MATERIAL FED BY A ROLLER

[75] Inventor: Romano Stefanoni, Nova Milanese, Italy

[73] Assignee: Ghezzi & Annoni S.P.A., Milano, Italy

[21] Appl. No.: 729,055

[22] Filed: Jul. 12, 1991

Related U.S. Application Data

[63] Continuation-in-part of Ser. No. 430,808, Nov. 2, 1989, abandoned.

[51] Int. Cl.[5] ..... B65H 19/30

[52] U.S. Cl. ..... 242/56 A; 242/64; 242/56.2

[58] Field of Search ..... 242/56 A, 56.2, 56.3, 242/56.7, 56.9, 64, 81

[56] References Cited

U.S. PATENT DOCUMENTS

| | | | |
|---|---|---|---|
| 2,970,786 | 2/1961 | Justus et al. | 242/56 A |
| 3,137,456 | 6/1964 | Weber et al. | 242/56 R |
| 3,547,365 | 12/1970 | Loase et al. | 242/56 R |
| 3,727,853 | 4/1973 | Knoshita | 242/56 A |
| 3,897,912 | 8/1975 | Tajima | 242/56 A |
| 4,024,782 | 5/1977 | Kron et al. | 242/56 A X |
| 4,033,521 | 7/1977 | Dee | 242/56 A |
| 4,111,377 | 9/1978 | Tetro et al. | 242/56 R |
| 4,208,019 | 6/1980 | Dusenbery | 242/56 A |
| 4,344,584 | 9/1982 | Schroeder | 242/56 A |
| 4,541,583 | 9/1985 | Forman et al. | 242/56 A |
| 4,611,769 | 9/1986 | Orbach | 242/56.9 |
| 4,846,416 | 7/1989 | Natale | 242/56 A |

*Primary Examiner*—Daniel P. Stodola
*Assistant Examiner*—John P. Darling
*Attorney, Agent, or Firm*—Bucknam and Archer

[57] ABSTRACT

The machine with a continuous operating cycle, is suitable for packaging in rolls various strip-shaped materials by a plurality of longitudinal cuts of a wide strip of material fed by a roller. The machine comprises at least one pair of spindles supporting a plurality of cores on which the strip-shaped materials, obtained by cutting a wide strip of material fed by a roller, will be wound. Once the rolls of material have been filled with the required quantity, the spindles are carried to a discharge station or unit, which cooperates with a supporting shaft on which the above discharge units carry the final rolls. The machine also comprises at least one pair of shafts to prearrange a new plurality of cores on the spindles for the start of a new packaging cycle.

17 Claims, 8 Drawing Sheets

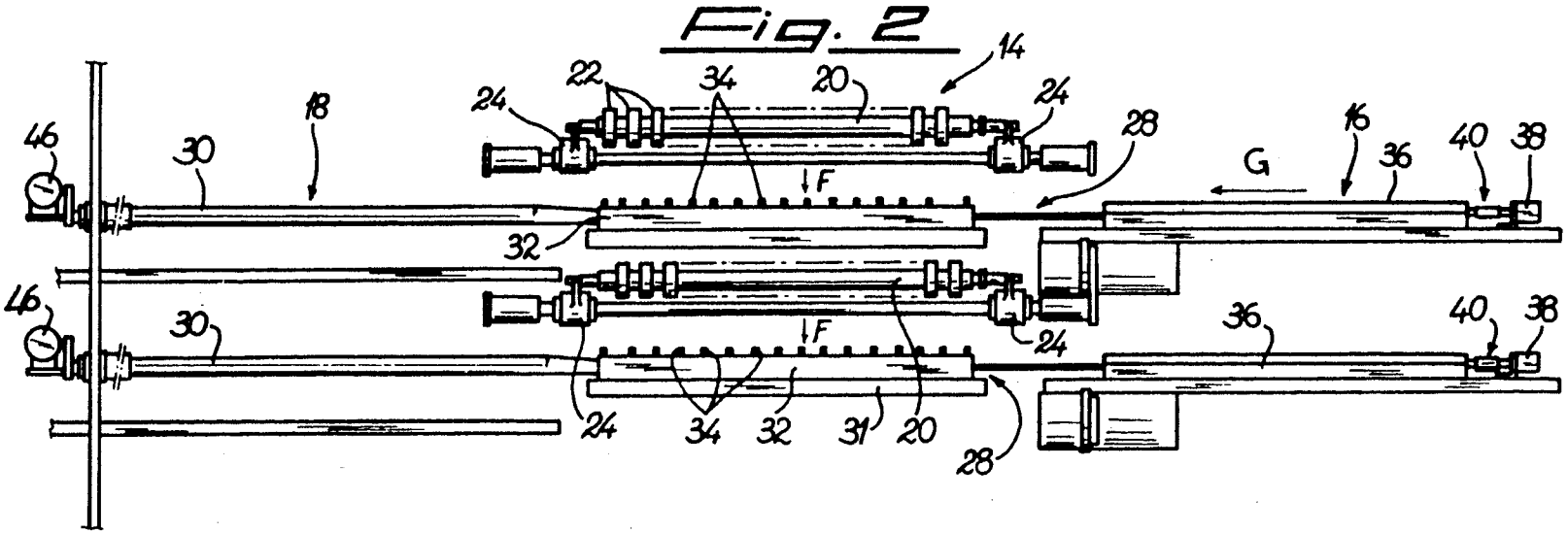
Fig. 2
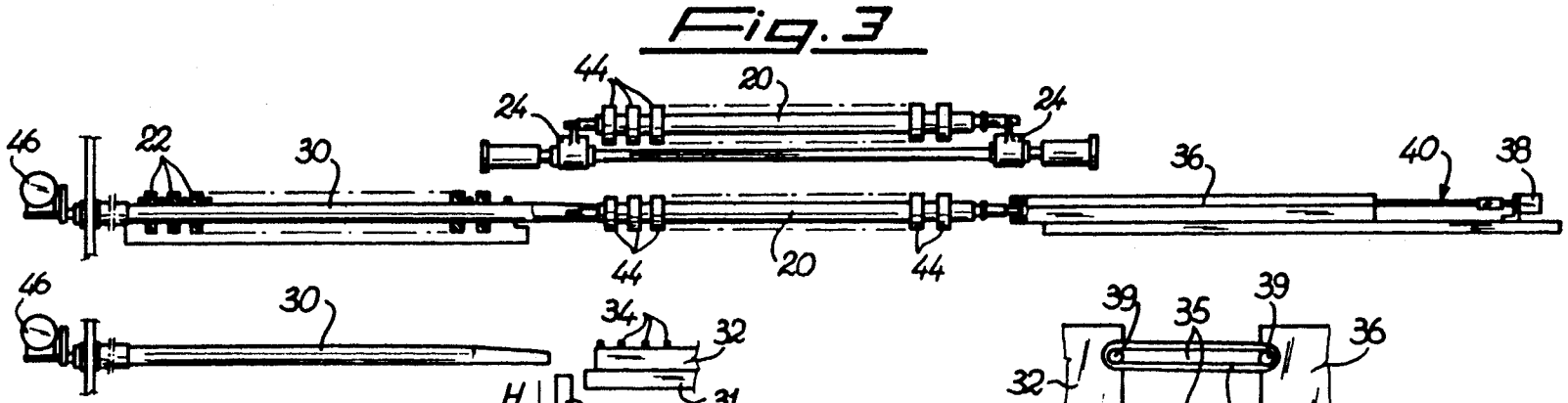
Fig. 3
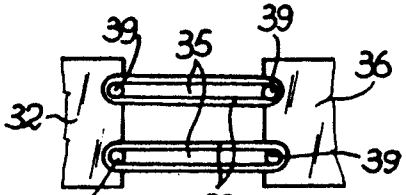
Fig. 4a
Fig. 4

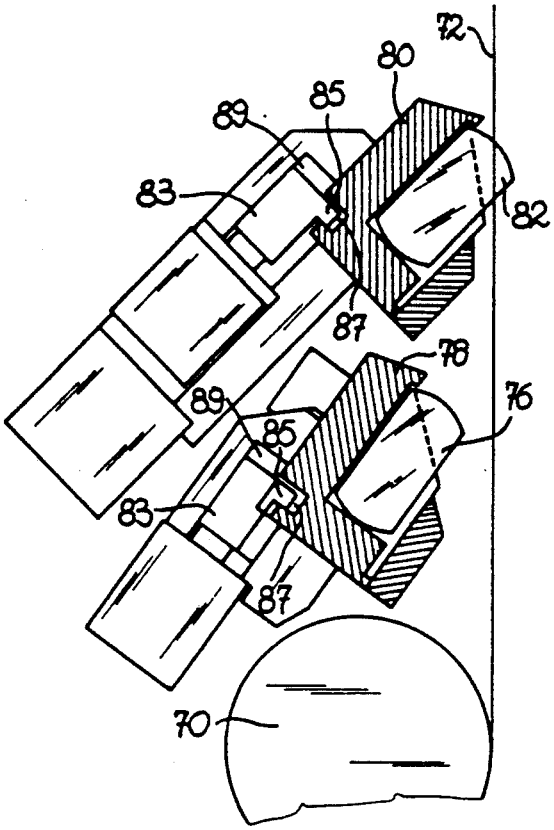
Fig. 7A
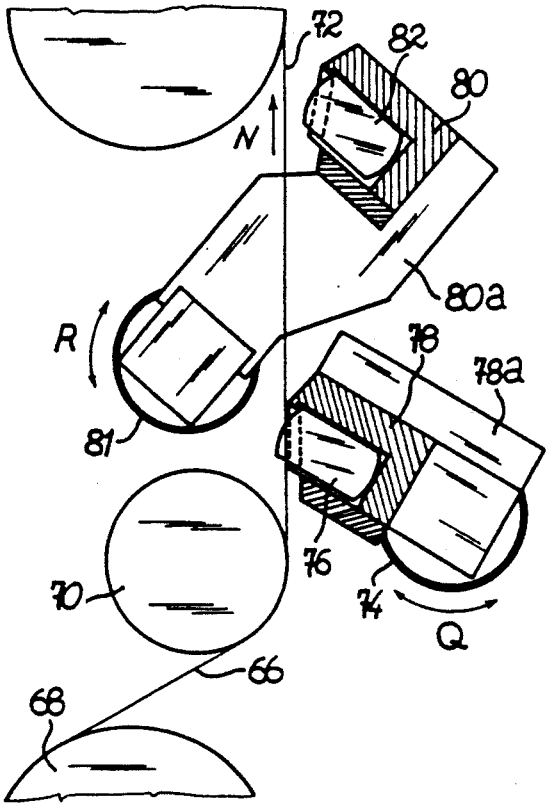
Fig. 7
Fig. 8
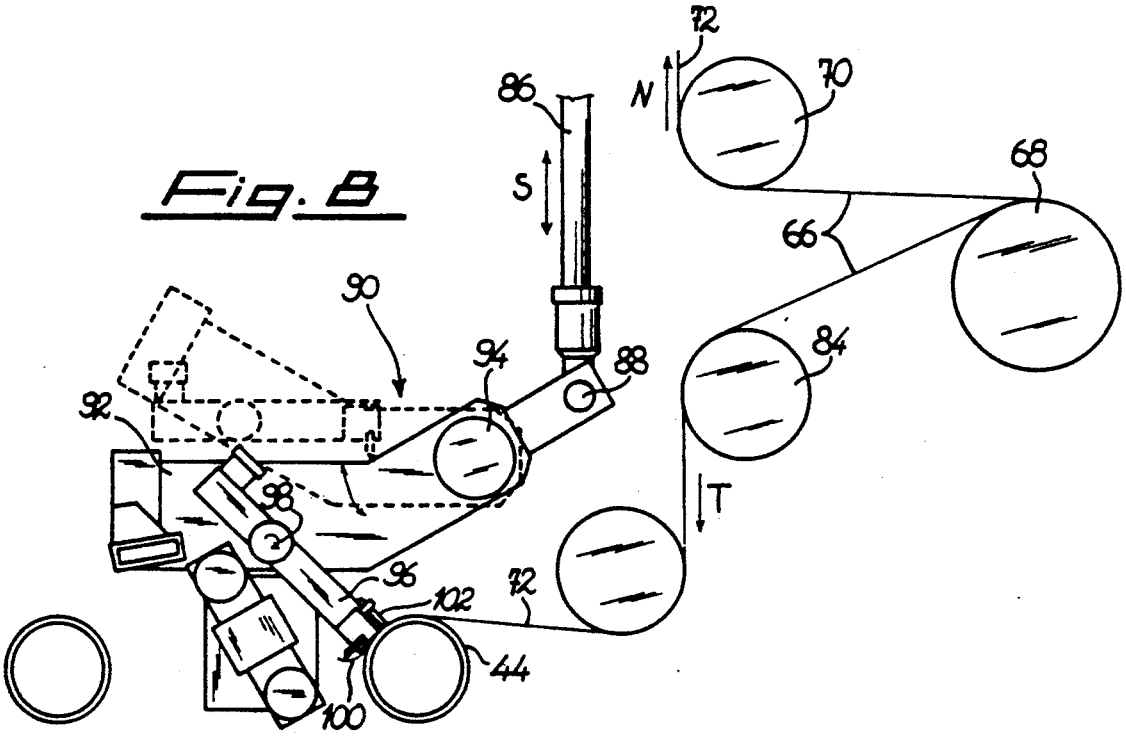

104
106
110
108
U
114
112
U
44
122
120
122
120
116
44
118
44
116
126
44
36
134
132
128
130
136
140
36
138
134
132
44
130
128

MACHINE WITH CONTINUOUS OPERATING CYCLE FOR THE PACKAGING IN ROLLS OF VARIOUS STRIP-SHAPED MATERIALS BY MEANS OF A PLURALITY OF SIMULTANEOUS LONGITUDINAL CUTS OF A WIDE STRIP OF MATERIAL FED BY A ROLLER

This is a continuation-in-part of application Ser. No. 07/430,808, filed Nov. 2, 1989, now abandoned.

The object of this invention is a machine, which, with a continuous operating cycle, makes it possible to package a plurality of rolls of various strip-shaped materials obtained by means of a plurality of longitudinal cuts of a wide strip of material fed by a roller. Machines of the above type are known, but they present problems in operation, as discussed hereinbelow.

A first problem of conventional machines derives from the fact that they must be stopped each time the rolls of material reach the required diameter, for discharge. The machine must also be stopped to change the cutting means or blades which make the longitudinal cut of the material, which reaches the machine in the form of a wide strip. The replacement of the blades is a drawback more serious than the first one as it is time-consuming. Another drawback of the machines of known type is that the supporting means of the rollers, known in the specific art as "spindle", must undergo a compound movement, in particular first a rotation, then a traverse, to discharge the rolls of material and to load a new plurality of cores for the purpose of receiving further strip-shaped material for the formation of another plurality of rolls. The above problem, besides the intrinsic increase of operating times, involves the necessity of using complicated devices to make it possible to carry out the above-mentioned compound movement.

The object of this invention is to provide an improved machine which eliminates the problems of the conventional machines. According to a first basic feature of the improved machine according to this invention, means are provided, described in detail hereinbelow, which consent it to make a continuous processing cycle without stops. Consequently, the operating times of the improved machine according to the invention are much shorter than those of known machines, with obvious reduction of costs. According to a further significant feature of the improved machine according to the invention, all the operating phases are clearly visible to the operator, who can therefore easily check whether the machine is operating correctly. Another advantage of the improved machine according to the invention is that the movement of the supporting means of the final rolls, subsequently simply called "spindle", is reduced to a simply rotation, thus eliminating the complex movement of the spindles of known machines.

A further new feature of the improved machine according to the invention is that the discharge of the rolls and loading of the cores take place with the spindle at a stand-still.

Another particularly advantageous aspect of the machine according to the invention is the elimination of dead times to change the blades, because the machine is provided with at least two pluralities of cutting blades, the first of which is made immediately operative for a time corresponding to an efficient cut by the blades, while the second plurality, inoperative during the above mentioned time, is automatically carried to the working condition without stopping the machine, while the first plurality of blades is simultaneously moved away from the work zone.

A firther novel feature of the machine according to the invention is that, to supply the cores, a single loader is provided, in which the cores are fed vertically, making this machine further simplified compared with the known types.

The features and advantages of the machine of this invention will be seen more clearly from the following details description of an non limiting embodiment of its construction, by reference to the attached drawings, in which:

FIG. 2 is a schematic view of the means for the formation of the rolls and their discharge;

FIG. 3 is a schematic front view of one of the above means in the operative phase of prearrangement of a new plurality of cores;

FIG. 4 is a partial schematic view of the above means in the operative discharge phase of the terminated rolls;

FIG. 4A shows the connection between the discharge shaft of the terminated rolls and loading of the cores;

FIG. 7 is a schematic lateral view showing the means to replace worn blades and put the new plurality of blades in operating condition;

FIG. 7A shows the means for rapid replacement of the worn blades;

FIG. 8 is a schematic lateral view showing the discharge phase of a terminated roll and the start of a new one;

Figure 1:
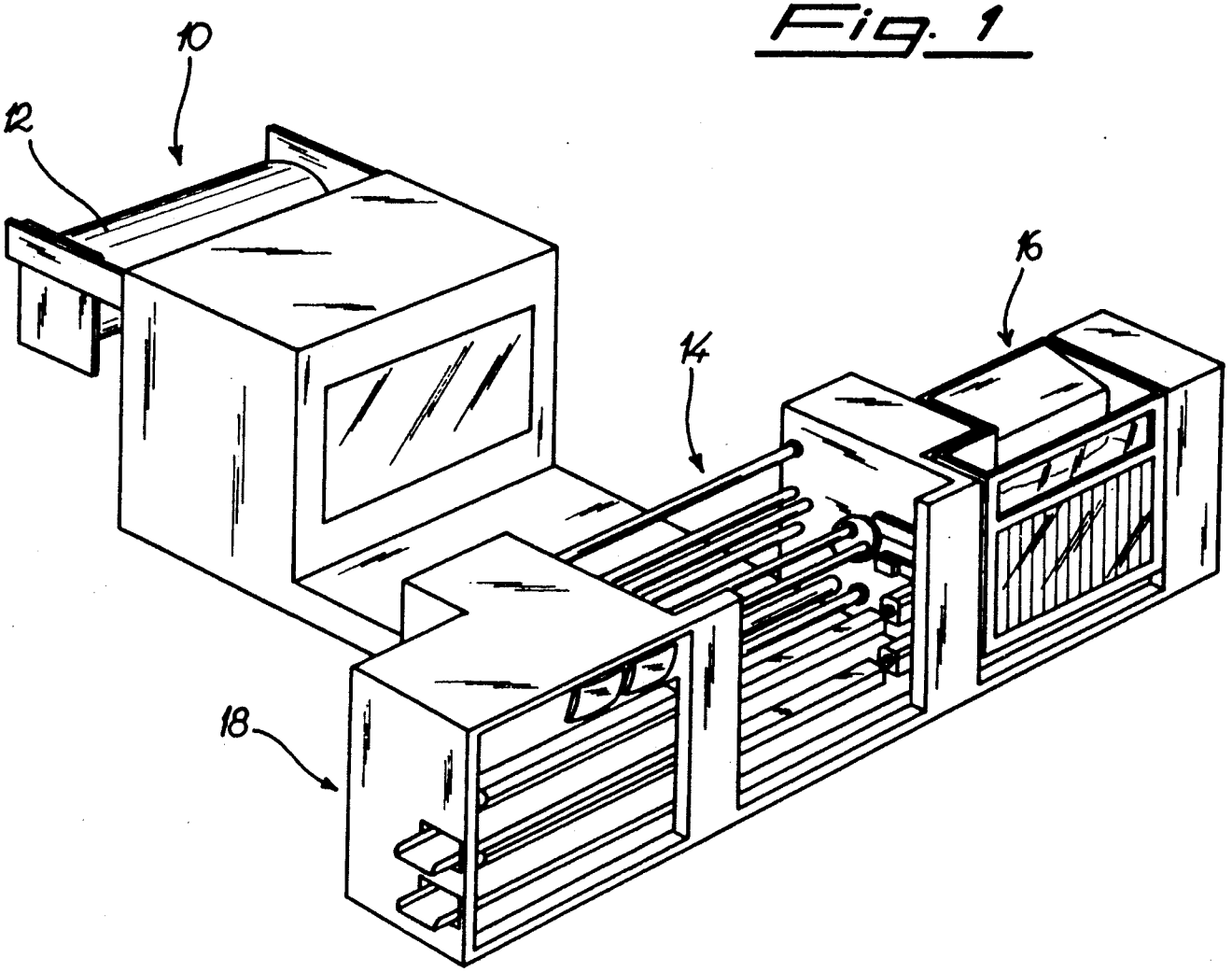
FIG. 1 is a schematic view of the entire machine according to this invention.
Figure 11:
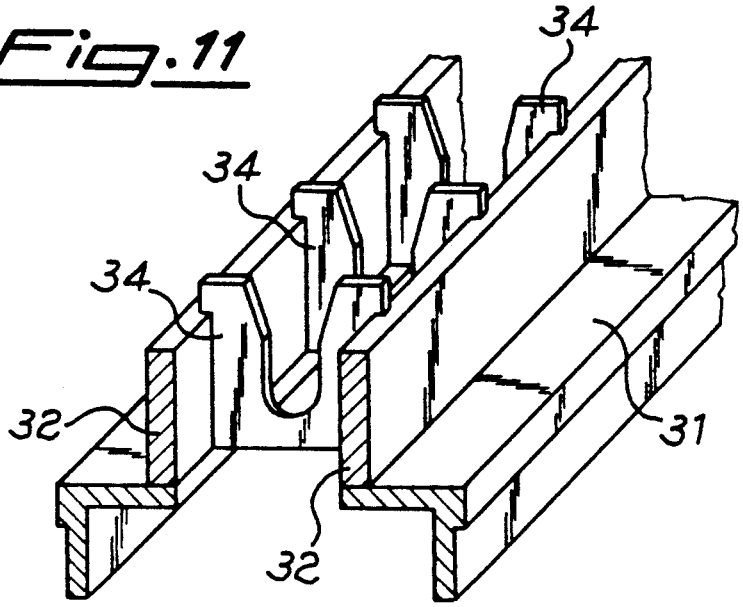
FIG. 11 is a schematic prospective view of the comb-shaped structure.
Figure 12:
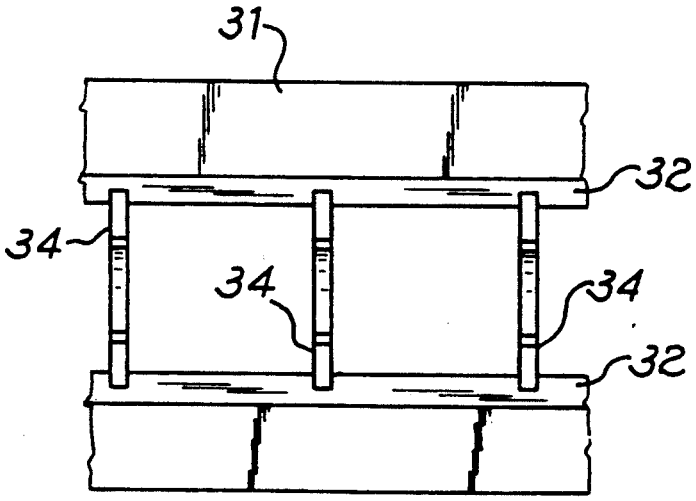

FIG. 12 is a schematic top view of the comb-shaped structure of FIG. 11. Referring first to FIG. 1, the machine of the present invention comprises: a feed station 10, in which a roller 12 of notable width is arranged; a roll forming station 14; a discharging station 18, and a core loading station 16.

The machine of the present invention provides a plurality of rolls as specified below by a series of longitudinal cuts on the strip of material fed by the roller 12.

The roll forming station 14 is arranged downstream from the feed station 10 and it is provided with a plurality of shafts or spindles on which the rolls of material will be formed.

The core loading station 16 is located on one side of the station 14; in this station 16 cores are loaded, then carried, as described below, to the station 14.

On the side opposite the previous one, the machine of the present invention comprises the discharging station 18 in which the rolls with the material wound on them are discharged to be sent, for example, to a stocking station not shown.

Making particular reference to FIG. 2, the roll forming station 14, the core loading station 16 and the discharging station 18 are described in detail. The roll forming station 14 will be first described.

This station is illustrated in FIGS. 2, 11 and 12.

This station comprises supporting means 20, called "spindle", which initially support the cores on which the strips of material obtained with a series of longitudinal cuts on the material coming from the roller 12 are gradually wound.

In FIG. 2 it is assumed that a plurality of terminated rolls 22 with the material wound thereon is already present, only some of them shown, which must be carried into the discharging station 18. The spindle 20 is supported for this purpose, at its ends by a pair of movable supporting elements or revolvers 24, provided with tailstocks to keep said spindle 20 in position. The revolvers 24 can be revolved round their longitudinal axis so that the spindle 20 is carried, through rotation, downwards in the direction of the arrow F opposite a discharge unit indicated with 28.

The discharge unit 28 permits removal of the terminated rolls 22 from the spindle 20 and their temporary prearrangement on a supporting shaft 30 provided in the discharging station 18 of the terminated rolls.

Figure 5:
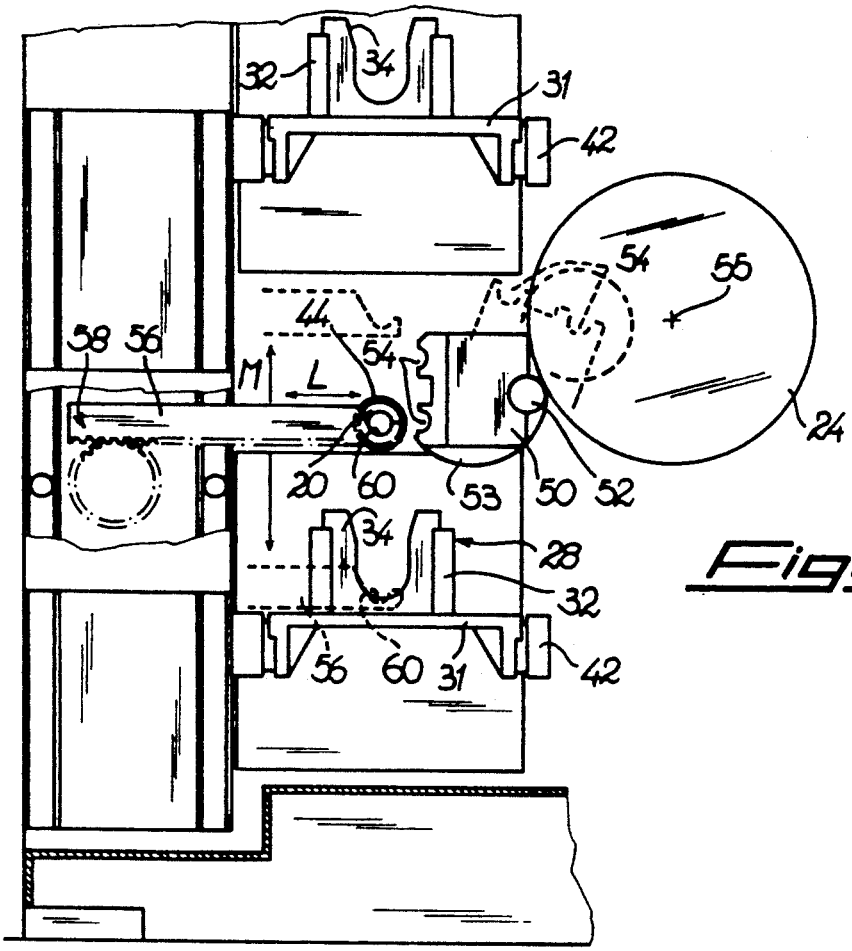
FIGS. 5 to 5H are schematic lateral views showing the movement of the supporting means of the rolls.

The discharge unit 28, a lateral view of which is shown in FIG. 5 and a prospective and top views respectively in FIGS. 11 and 12, comprises a supporting bracket 31, above which are provided two lateral uprights 32, which support a series of distanced U-shaped sections 34, inserted in special seats of the uprights 32. These sections 34 form, as can be seen in detail in FIGS. 2, 11 and 12 a substantially comb-shaped structure designed to receive the rolls 22, each of which are positioned between two adjacent sections 34. The space between two adjacent sections 34 is open so that the termined rolls 22 are maintained in position by the spindle 20.

Figures 9, 10:
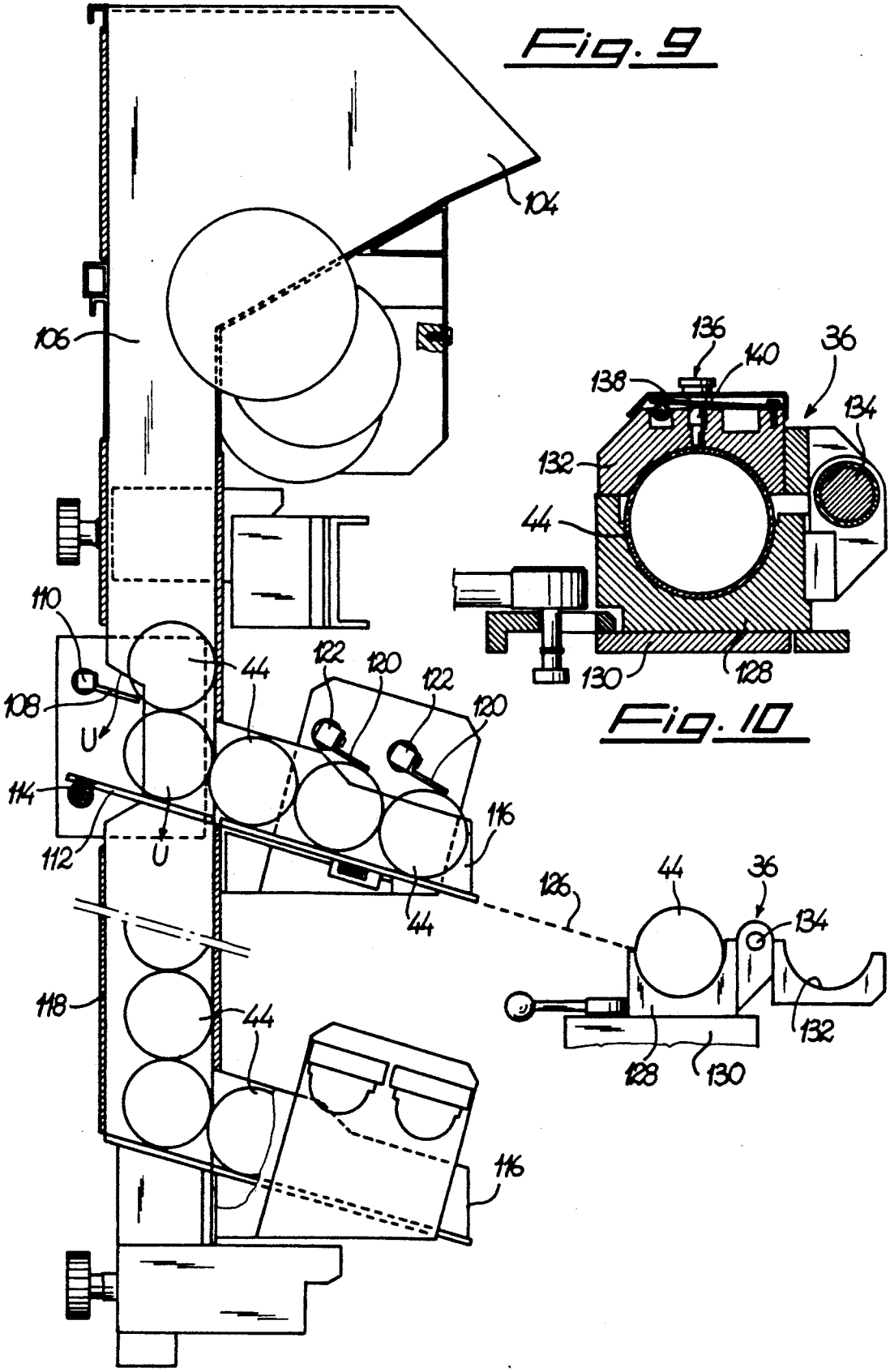
FIG. 9 is a schematic lateral view showing the supply of cores to the spindles.
FIG. 10 is a view in cross-section of a detail of the supporting means of the cores.

The core loading station 16 comprises a motor 38, a worm screw 40 and a hollow shaft 36, sliding along supporting means 130, as illustrated in FIGS. 10 2 and 3.

Hollow shaft 36 is opened for positioning the cores 44 therein, as hereinafter described.

The discharging station 18 comprises a shaft 30 and a motor 46 which operates the horizontal motion of the shaft 30 by a worm screw.

The uprights 32 are connected to the hollow shaft 36 by rods 33 which present, longitudinally, a slit 35 which extends for almost their entire length.

The rods 33 are engaged at their ends with stop elements 39, respectively integral to the upright 32 and shaft 36. The stop elements therefore slide into the slits 35 of the rods and therefore, when the shaft 36 moves in the direction of arrow G of FIG. 2, the opposite ends of the upright 32 and shaft 36 can approach each other, coming into contact.

When the shaft 36 moves in the direction opposite to the previous one, the above mentioned opposite ends return to the position illustrated in FIG. 4A.

When the spindle 20 has terminated its downward rotation, the terminated rolls 22 with the spindle 20, on which they are inserted, are positioned in the comb-shaped structure so that the terminated rolls are disposed between two adjacent sections 34. The terminated rolls 22 are supported by the spindle 20.

Motor 38 is operated and the hollow shaft 36 with the cores 44 fixed in the hollow shaft is moved in the direction G (see FIG. 2). When the shaft 36 contacts the uprights 32 these uprights are pushed and moved in the same direction G. During this motion only the uprights 32, the sections 34, bracket 31 and the terminated rolls 22 are moved. The bracket 31 slides along the supporting means 42. However, spindle 20 is immobile, since shaft 36 is hollow and spindle 20 goes through the holes of the cores 44 arranged and fixed in the seats of the cavity of the hollow shaft 36. During this movement the fixed spindle 20 receives the cores 44 arranged in fixed positions along the hollow shaft 36.

As can be seen in detail in FIG. 3, the terminated rolls 22, with the uprights 32, section 34 and bracket 31, are therefore positioned on the supporting shaft 30, freeing the spindle 20 on which a new set of cores 44 is simultaneously positioned, carried by the hollow shaft 36 by the action of motor 38. The hollow shaft 36 is opened by the spindle 20 with the cores 44 arranged thereon is removed by the revolver 24.

Motor 46 is then operated and the shaft 30 is moved away from the roll forming station 14 so as to form a void (see FIG. 4).

Motor 38 is moved in the opposite direction with respect to the previous direction G and shaft 36 drags uprights 32 in the same direction. When each terminated roll 22 is in the position corresponding to the void between shaft 30 and the roll forming station 14, it drops because it is not supported by shaft 30 and because the space between two adjacent sections 34 of the comb-shaped structure is empty.

The hollow shaft 36 is opened for positioning the cores "therein", in the core loading station 16. Moreover, the hollow shaft 36 is opened for removing the cores 44 inserted in the spindle 20 by the revolver 24, in the roll forming station 14. The position of the new cores 44 on the spindle 20 is automatic because the cores are arranged in suitable seats of the hollow shaft 36.

The bracket 31, section 34 and uprights 32 are returned from this position in FIG. 3 to the position of FIG. 2 to receive additional terminated rolls 22, by the action of motor 38 when it moves the hollow shaft 36 and, therefore, uprights 32, connected to the hollow shaft 36 by rods 33, in a direction opposite to direction 4 as shown in FIG. 4A.

Through this connection the shaft 36 can control a transversal motion of the uprights 32, thus carrying all terminated rolls 22 to place them on the shaft 30 (as shown in FIG. 3). When the shaft 36 is made to move back in reverse direction to that of arrow G, the above connection, makes it possible to return the uprights 32 to the position indicated in FIG. 2, thus discharging the terminated rolls 22 at the collection station, as specified above.

Once a new set of cores 44 has been positioned on the spindle 20, the latter, through rotation of the revolver 24 in the direction opposite to the previous one, is restored to its initial position. With particular reference to FIG. 5, the above operating phases are shown, in lateral view, for the movement of the spindle 20 to the discharge unit 28 and its positioning for the formation of a set of rolls of material 22.

In FIG. 5, in which the same elements as the previous drawings have been indicated with the same reference numbers, associated to the revolver 24 sketched in this Figure, a turret 50 is carried by the casing of the machine revolvingly by a revolving shaft 52, suitably shaped on one face to receive and discharge the spindles 20.

Figure 5A:
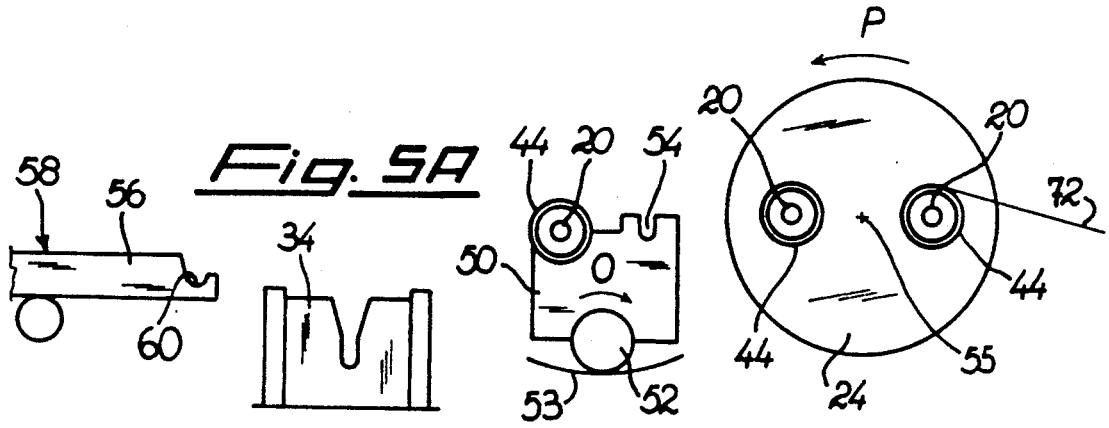
Figure 5B:
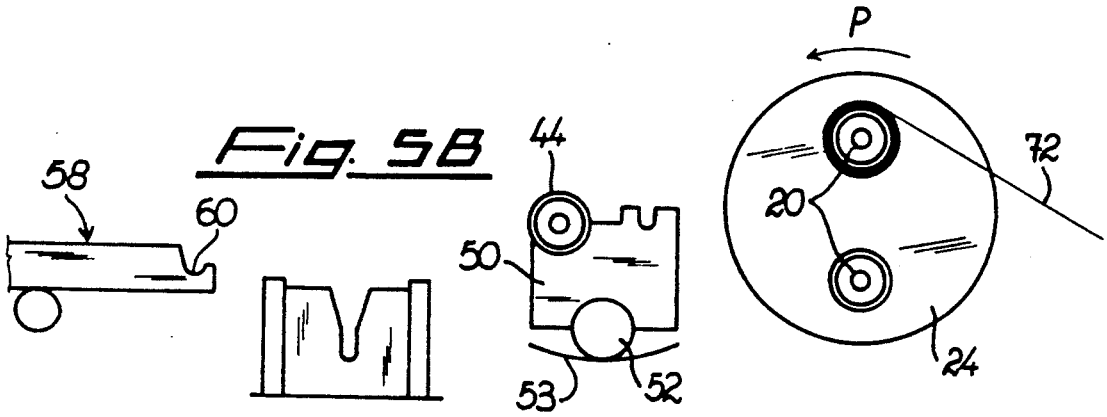
Figure 5C:
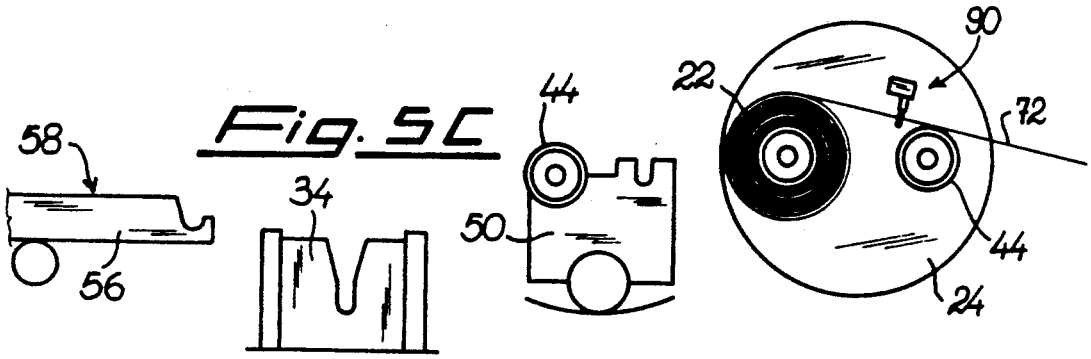
Figure 5D:
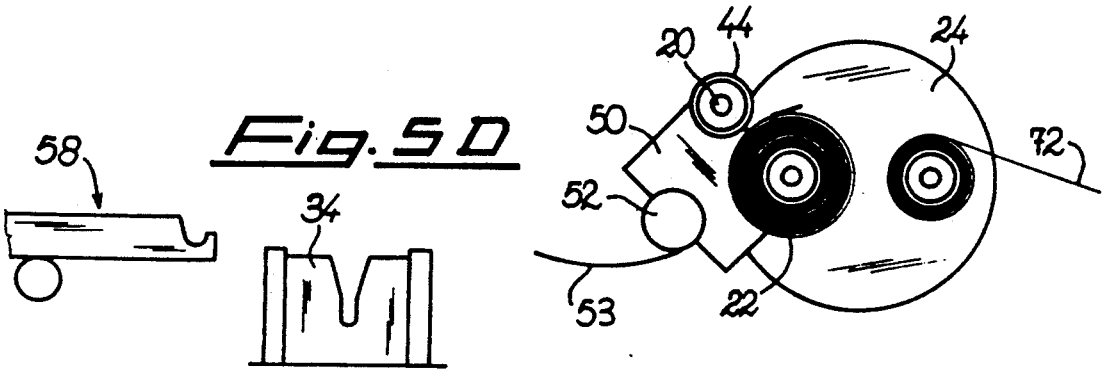
Figure 5E:
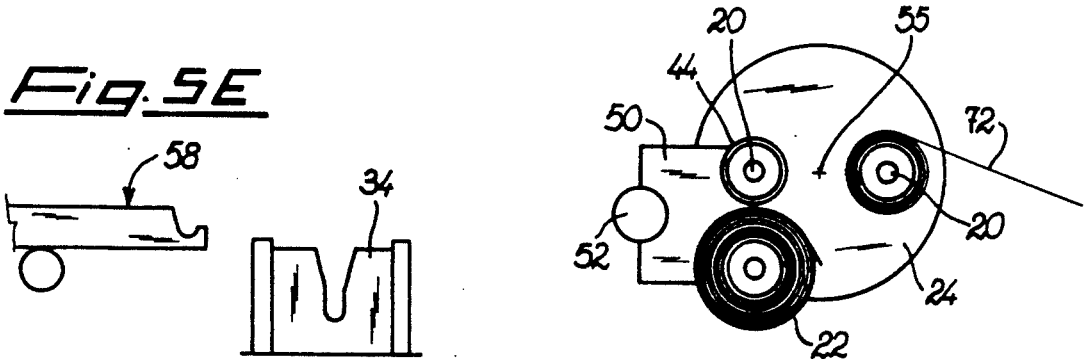
Figure 5F:
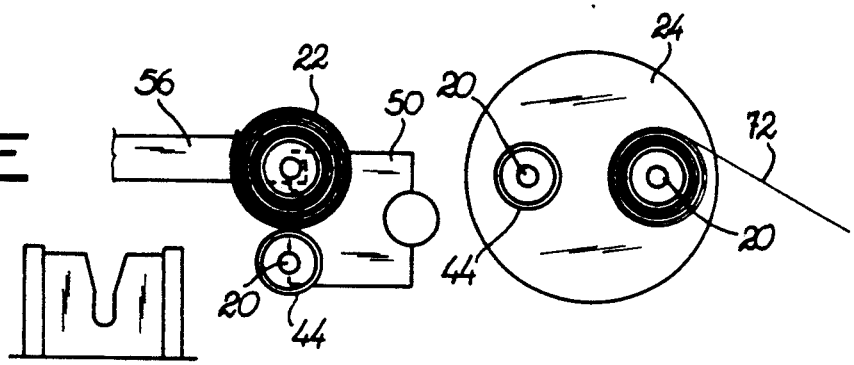
Figure 5G:
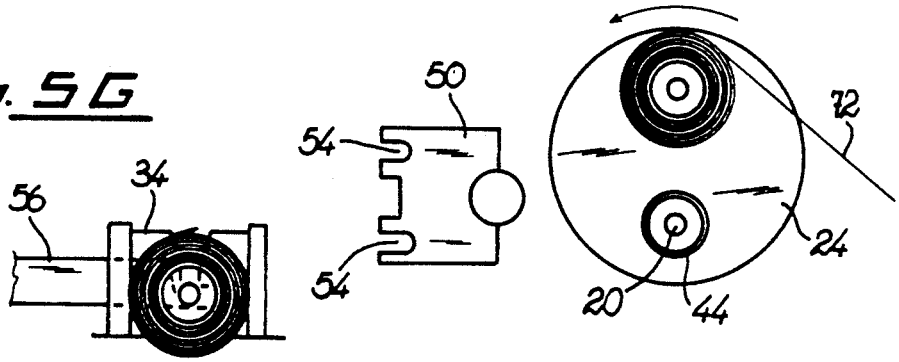
Figure 5H:
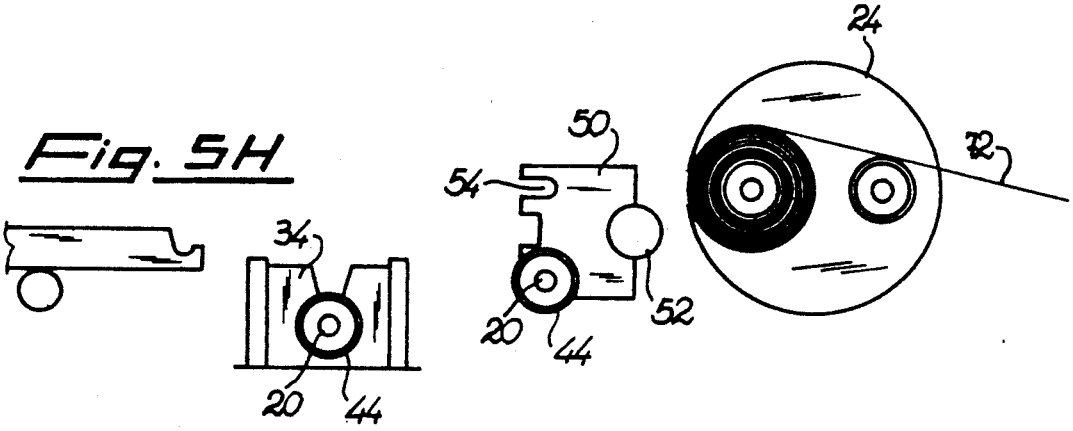

In the above mentioned FIGS. 5 to 5H, one end side of the turret 50 is illustrated, and, on the opposite end of the shaft 52, a corresponding, identical side will be provided.

The turret 50 is provided, on one side, with two shaped essentially semicircular grooves 54, each of which is adapted to receive and support one of the ends of a spindle 20.

In particular, the distance between the grooves 54 is such that the turret 50 can simultaneously support a spindle 20 supporting the cores 44, together with a spindle 20 supporting a plurality of terminated rolls 22, as results, in particular, from an examination of FIGS. 5D and 5E.

In FIG. 5 the turret 50 is represented with a continuous line in the position in which it is about to receive a spindle 20 loaded with cores 44 thanks to the movement of an operative arm 56 of which more will be said later. In FIG. 5A the turret has made a clockwise rotation of approximately 90° with respect to the previous position in clockwise direction marked by arrow 0 in the same Figure.

The spindle 20 loaded with cores 44 will now be suitably housed with its ends on the two turrets 50.

As can be seen from FIG. 5A, the adjacent grooves 54 are empty for the moment, as they do not support any spindle.

With particular reference to FIG. 5A, the revolver 24 is provided with suitable supporting means essentially positioned 180° from each other, provided to support a pair of spindles 20.

Furthermore, the revolver 24 is carried revolvingly by a shaft 55. The spindle located on the left of the revolver 24 in FIG. 5A is loaded with cores 44, while the spindle 20 on the right of the same figure is also loaded with cores 44, but on them are forming the rolls 22, as it is seen that they are being reached by the strips of material 72.

The revolver 24 is now given, in any known way, counterclockwise rotation in the direction to arrow P of FIG. 5A with such a speed, referring also to FIGS. 5B and 5C, so that the two spindles 20 gradually occupy the position previously occupied by the other. At this point, the rotation of the revolver 24 is momentarily stopped (FIG. 5C) and on the spindle 20, which is now located on the left, there is placed a plurality of rolls 22, with the material wound on them, while on the spindle 20, now on the right, will start the formation of a new set of rolls 22.

As can be noted again from FIG. 5C, the strips of material 72 now present a direction that is substantially tangent to the cores 44 of the spindle 20 on the right.

A cutting station 90, described in detail below, now cuts the strips 72, having predominantly or simultaneously applied a terminal strip. At this point the machine, thanks to means of coordination not shown, discharges the terminated rolls 22, removing the relevant spindle 20 from the revolver 24.

This operative phase will now be described with reference to FIGS. 5C to 5H.

The turret 50 is first put in rotation so that it rotates round the shaft 52, which can slide in a suitably shaped groove 53.

In this way, simultaneously to rotation of the turret 50, it is raised upwards.

In FIG. 5D it is seen that the empty grooves 54 of the turret 50 grip the spindle 20 on which are present the terminated rolls of material 22, while simultaneously on the other spindle 20, located on the revolver 24, a new set of rolls 22 is formed.

Rotation of the turret 50 continues while the spindle is maintained at a standstill until (FIG. 5E) the spindle 20 loaded with the cores 44 is placed on the revolver 24. The turret 50, which suitably supports the spindle 20 loaded with rolls 22 just removed from the revolver 24, continues rotating until it reaches the position in FIG. 5F.

At this point starts, with respect to the revolver 24, an operative phase substantially identical to that described in FIGS. 5A to 5C.

In fact, it is re-rotated, always in counterclockwise direction, marked by arrow P at a speed similar to that specified above.

The turret, during this operative phase, is not rotated and the machine, by means of means described below, removes the spindle 20 loaded with terminated rolls 22 from the turret.

FIGS. 5G and 5H illustrate, for the revolver 24, the operative completion of the rolls 22 and the cutting phase of the strips of material 72. The machine according to the invention, to remove the spindle 20 loaded with rolls 22 from the turret 50, comprises an operative arm 56 which can advance both in horizontal direction backwards and forwards, as indicated by arrow L in FIG. 5, and vertically upwards and downwards, as indicated by arrow M of the same figure.

The operative arm 56 is controlled in its horizontal displacements by schematized means, e.g. as means with rack 58. Its vertical displacements will be controlled by means not shown, e.g. means with piston or similar means.

It is now assumed to start from the position of the operative arm 56 shown in FIG. 5E, from which it is made advance up to the position in FIG. 5F. The special conformation of the grooves 60 provided at the ends of the two operative arms 56 will permit the coupling and withdrawal of the spindle 20 loaded with rolls 22 by turret 50.

This operative phase is easily understood from the examination of FIG. 5F (coupling of spindle 20) and FIG. 5G (deposit of the spindle in discharge station 28), as it is seen that the operative arms 56 have been first made to move back, and, now referring also in particular to FIG. 5, they have undergone a downward transversal up to the position represented with dotted line from which they are again made to move back, leaving the spindle loaded with rolls 22 in discharge unit 28.

The operative phases described above for one of the spindles 20 must be considered identically valid for the other spindle 20, for which the description of the above phases is obviously omitted.

According to a further particularly advantageous feature of the machine according to the invention, means are provided to control the rotations of the spindles 20 in synchronism with one another.

Figure 6:
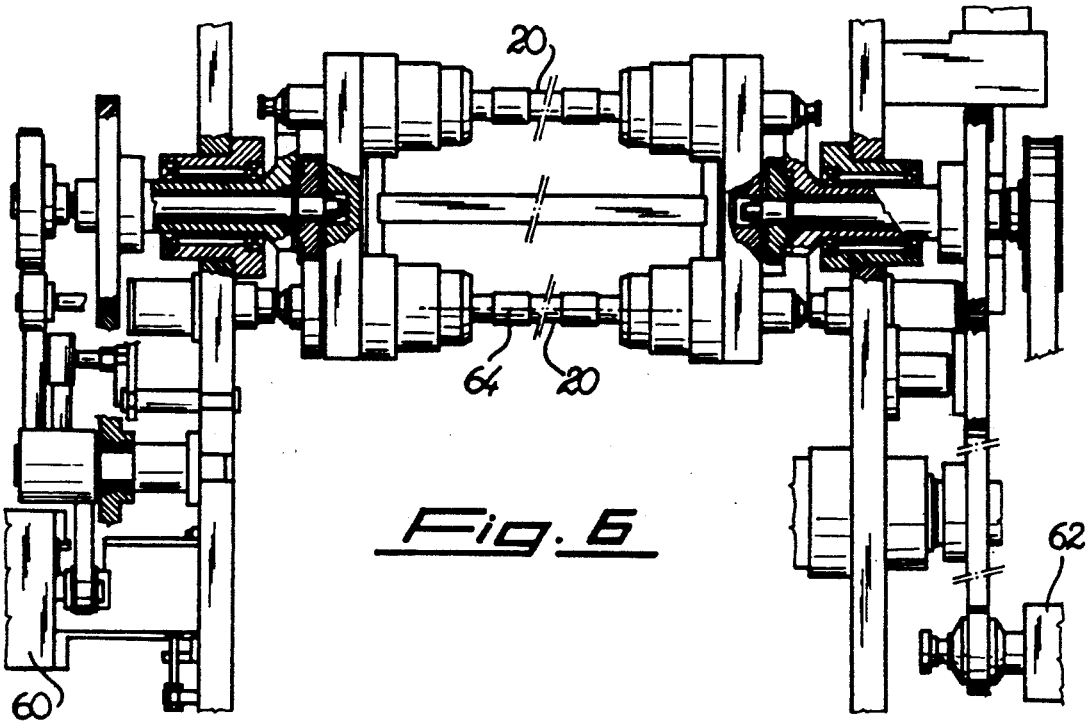
FIG. 6 is a front view showing the means to synchronize the rotation speeds of the above mentioned spindles.

These means are shown in detail in FIG. 6 and described below. With reference to this Figure, these means comprise a first and second control motor 60 and 62, which are connected to the spindles 20 by means of return kinematic means which carry the movement of rotation of both the first control motor 60 and the second control motor 62 to the axis 64 of one of the spindles 20 the rotations of which involve those of the spindles 20, in such a way that, through these kinematic means, the peripheral speeds are identical.

One of the spindles 20 will be loaded with rolls of material 22 with the material almost completely wound on them while the other will be loaded with rolls 22 started.

The motors 60 and 62 can be controlled in a known manner by means of a card programmer which controls the operation of both motors in order to obtain the desired synchronism so that the peripheral speed of the spindles 20 is similar.

A detailed description will now be given of the cutting unit of the machine according to the invention, which, according to an advantageous feature, permits automatic replacement of a set of worn blades with a set of new blades without interrupting operation of the machine.

With reference to FIG. 7, the material in strip 66 of great width comes from a return roller 68 and advances, after a further return roller 70, in the direction of arrow N to be cut into strips of prefixed width which are wound on cores 22*a*, which, traditionally, are prefabricated in cardboard, plastic or similar.

The means which cut the strip 66 into thin strips 72 comprise a first plurality of blades 76 carried by suitably shaped means of support 78, which, at one end, are fixed on a supporting shaft 74 carried revolvingly by the casing of the machine which can rotate in the direction of the double arrow Q in FIG. 7.

The first set of blades 76 is in the operative position in which the blades cut the wide strip 66 into thin strips 72, and, in particular, the cutting takes place on one side of the wide strip 66, which can be defined as external side with respect to same.

As mentioned above, the machine according to the invention has made it possible to eliminate dead times for replacement of the cutting means, as, as noted in particular in FIG. 7, it presents a second plurality of blades 82 carried by means of support 80, which are intended to operatively replace the blades 76 of the first set when the latter are worn.

The blades 82 of the second set, now in inactive position, are placed on a second shaft 81 which can be made to rotate in the direction of double arrow R of FIG. 7.

The second shaft 81 is staggered with respect to the first shaft 74 and essentially parallel to it.

Furthermore, the second shaft 81 is placed, with respect to the thin strips 72, on the opposite side and it may be defined as an internal side with respect to same.

Making particular reference to FIG. 7A, the means are described which consent rapid replacement of the blades when they are worn. This means are identical for each set of blades and comprise a small piston 83 the shank of which is movable in the interior of a hollow 89 of the means of support 78 and 80, this shank being provided with a projection 85, engaged in a hollow 87 of the means of support 78 and 80.

The width of the hollow 87 is greater than that of the projection 85. In this way, when the blades, e.g. blades 82, are in operative cutting position, the shank 83 is made re-enter in the small piston so that the projection 85 is engaged in a face of the hollow 87 locking the support 80. When the blades must be changed, as is the case of the blades 76, a limited emission of the shank 83 is controlled in known manner so that the projection 85 is released from the supporting elements 78, which may be easily and quickly removed.

A new set of blades is then applied to support 78.

Referring to FIGS. 7 and 7A, it is noted that cutting of the wide strip 66 takes place on its external side (FIG. 7) or internal side (7A).

These two forms of construction, which may be used alternatively, are chosen according to the material to be cut.

It should also be noted that, in the form of construction shown in FIG. 7, means to release supporting elements 78 and 80 are not provided as these elements are supported in any known manner by a cross-piece supported at the end by two supporting arms 80*a* and 78*a*.

It will be sufficient to remove the cross-piece supporting the worn blades and replace the blades with a set of new ones.

Naturally, also in the case of the form of construction in FIG. 7A, the supporting means of the blades will be supported by a corresponding cross-piece and the procedure will be similar, operating the small pistons 83 later when the cross-piece has been removed from the machine. From the above description it is evident that there is a considerable advantage in being able to replace a cutting unit 76 with another having to stop the machine.

With particular reference to FIG. 8, the part of the machine according to the invention is described, which ejects a terminated roll of material 22 and starts a new roll on a core 44.

The strip material 66 comes also, in this case, from a return roller 68 and it, being in double layer, is directed to the return roller 70 shown in FIG. 7 and to another return 84, so that the strip 66 is sent to the upper spindle 20 in the direction of arrow N and to the lower spindle 20 in the direction of arrow T.

Longitudinal cutting of the strip 66 takes place as described above, and, in FIG. 8, is shown and described below, the manner by which the formation of a new roll 22 of material starts on a core 44.

This part of the machine comprises an operative piston not illustrated, provided for the movement in the direction of double arrow S of FIG. 8 of an arm 86, hinged in 88, and a unit for the formation of a new roll of material indicated in the complex with 90.

The unit 90 comprises a support 92 the rotation of which is controlled by the arm 86, since the support 92 is hinged in 94 to the casing of the machine.

The support 92 is shown with broken line in the inactive position and with continuous line in the work position.

Once the arm 86 is driven to make an upward transversal motion, the support 92 will correspondingly be brought to the lowered position in which it is represented with continuous line.

On the support 92 is placed a further operative arm 96, hinged in 98 to support 92, which is provided, at one end, with cutting elements 100 to operate on the cores 44 for the start of a new roll of material and for the transversal cutting of the thin strip of material 72 so that it is fixed on the core 44.

The second operative arm 96 is provided with means 102, which, pressing the end of the thin strip 72 on the core 44, stretch the latter, causing its peripheral adhesion on core 44 after application with known means, not shown, of a strip. When the thin strip 72 has continued its forward movement, thanks also to the rotation of core 44, its end is engaged in cutting element 100 of the operative arm 96 which therefore cuts this end so that the thin strip 72 can be wound on core 44.

Making particular reference to FIG. 9, the feed station 10 of the cores 44 to the machine is described.

According to a feature of this invention, the cores 44 are visible outside the machine because there are no mechanisms in movement in front of the feed station of the cores as in known machines.

The feed station of the cores 44 comprises a feed hopper 104 provided in known manner with means for arranging the cores 44 in order, even if they are inserted haphazardly in the hopper 104.

The cores 44 descend, from the hopper 104, into a feed duct 106 by gravity and dispose superimposed one on the other so that can be sent one at a time to the station in which the shaft 36 on which they must be loaded is positioned.

The means which feed the cores 44, one at a time, to the packaging station of each of the spindles 20, comprise means to temporarily stop one core 44 at a time and permit its feed to the station in which the shaft 36 is placed.

The above means, which may be connected to a card programmer or similar for sequential operation, comprise stops placed on two planes, each corresponding to one of the spindles 201, the stops being removable. FIG. 9 shows a detailed schematic view of the unit that permits the feed of one support of the cores, as the other will be identical. The unit which feeds the cores one at a time comprises, first of all, a first stop 108 composed of an arm against which a core 44 stops, which is held, on the opposite side, by the side wall of the feed duct 106. The stop 108 is hinged on a small shaft 110, which can be rotated in clockwise direction according to the direction of arrow U so that it permits the fall of core 44 on a further stop 112, also composed of an arm hinged in 114 on a control shaft, connected, like the small shaft 110, to means programmable, not shown.

The stop arm 112 is longer than the stop arm 108 as it has a different, supplementary function.

The arm 112, in fact, permits the feeding of core 44 to a duct 116 carrying the cores 44 to the relevant loading station. Alternatively, rotated in the direction of arrow U in FIG. 9, the arm 112 permits the further descent of core 44 into a further feed duct 118 to carry the cores 44 towards the other loading unit of the cores.

With reference to FIG. 9, the cores 44 are perfectly aligned in both the ducts 116, which carry them to the loading station 36, and in the vertical ducts 118 fed by hopper 104.

Each of the feed ducts of cores 44 to the loading station comprises, along its route, a plurality of stops 120, consisting, like stops 108 and 112, of stop arms each hinged on its control shafts 122 connected to the same programmable means which control operation of the shafts 110 and 114. Once the cores 44 are fed to ducts 116, the stop arms 120 withhold the cores 44 in the position shown in FIG. 9.

In the embodiment shown, the machine according to the invention withholds one pair of cores 44 at a time, since there are two stop arms 120. The above mentioned programmable means first free the core 44 placed in the front, by means of counterclockwise rotation of the arm 120 associated to it, and, once this arm is returned to stop position, a counterclockwise rotation of the preceding arm 120 will be commanded so that another core 44 goes to the exit end of feed duct 116.

The operating cycle of the machine according to the invention can alternatively provide a complete feeding of the upper duct 116 with consequent filling of the loading station of the cores, associated to upper spindle 20, and, subsequently, a complete feeding of the loading station of the cores associated to lower spindle 20. Alternatively, one core 44 at a time is fed for the loading station of the upper and lower cores. In both the above alternatives, loading of the cores 44 to the machine will be fast and reliable.

A description will now be given, with particular reference to FIG. 9 and FIG. 10, of the loading station 16 of the cores 44, which are fed, as described above, by the feed station 10.

The loading station 16 receives the cores 44 by means of any known means, e.g. an inclined plane 126 shown with broken line in FIG. 9. This station, comprises shaft 36, is now described in detail.

The shaft 36 is constituted by two parts or jaws 128 and 132 hinged at 134. The jaws 128 and 132 are initially open to receive core 44. The loading station of cores 44 will therefore subsequently be indicated as shaft or station 36.

The position described above is shown in FIG. 9, in which the shaft 36 presents a lower jaw 128 integral to supporting means 130 and a upper jaw 132 hinged in 134 to an upright integral to supporting means 130.

Both jaws 128 and 132 have an inner essentially semicircular shape, so that, when they are coupled to one another and are made integral, they enclose cores 44 in their seats, as shown in FIG. 10. The upper jaw 132 is opened when the spindle 20 with the cores 44 arranged thereon is removed by the revolver 24. When the cores 44 are arranged in all the seats of the lower jaw 128, the upper jaw 132 is closed by the operator so that the cores 44 are maintained in the fixed and determined positions during the movement of the hallow shaft 36, including the cores, towards the forming station 14.

With reference to FIG. 10, sensor means 136 are provided in discharge station 36 to detect the presence of the single cores 44 in the above station and their correct positioning in same.

This sensor means 136 consists of an electric switch comprising a plate 138 which is stressed upwards by a pin 140 pushed in the direction occupied by the core 44. The sensor means 136 will be connected in known manner to luminous, acoustic or similar means to confirm correct positioning of cores 44.

From the above description, the advantages are evident of the use of the machine according to the invention which, thanks to its special conformation, offers a continuous operation with automatic cycle, thus eliminating the dead times of traditional machines.

Although the invention has been described in conjunction with a specific embodiment, it is evident that many alternatives and variations will be apparent to those skilled in the art in light of the foregoing description. Accordingly, the invention is intended to embrace all of the alternatives variations that fall within the spirit and scope as set forth in the appended claims.

I claim:

1. A machine for packaging strips of a material in wound-on rolls with a continuous cycle of operation, which comprises means (12) for feeding a wide strip of said material (66) in contact with cutting means for cutting longitudinally said strip into a plurality of narrow strips (72) of predetermined width, at least one spindle (20) supporting a plurality of cores (44); each of said cores having wound thereon each of said narrow strips of material, means for transferring said narrow strips of material onto said cores, movable revolving means (24) for supporting said spindle at both ends thereof and for rotating said spindle and imparting to said spindle a downward motion towards a discharging station (18) in an initial position and a collection station, said cores (44) being positioned in an initial position in a hollow shaft (36) without strips of a material wound thereon, said narrow strips obtained by said cutting means being gradually wound on said cores, a discharging station (18) for discharging said wound-on rolls, each of said wound-on rolls being placed on a first shaft (30) for removal therefrom to a loading station (16), said discharging station having a supporting bracket (31), a pair of uprights (32), a plurality of U-shaped elements (34) supported by said uprights, said U-shaped elements receiving each of said wound-on rolls, said hollow shaft (36) moving from right to left and from left to right, the motion of said spindle downward ending when the wound-on rolls have been placed on said U-shaped elements and when said first shaft (30) carries said wound-on rolls for removal one at a time to said collection station, said spindle then returning to its initial position and being still during the motion of said first shaft, whereby a successive plurality of cores is placed on said spindle, control means (46) for causing the motion of said first shaft (30), said machine has a frame, said frame has at least one turret (50), said movable revolving means (24) is connected to said turret, a revolving shaft (52) revolves said turret, said turret making a rotational and a transversal motion, said turret consisting of at least one pair of plates, each plate having at least one pair of grooves (54), the ends of said spindle being received in said groove, each turret having an arm (56) capable of moving vertically and transversely, said hollow shaft (36) controlling the removal of the wound-on rolls, and the loading of successive rolls on said cores by its transversal motion from right to left and from left to right.

2. The machine according to claim 1, wherein a worm screw (40) controls the advance of said hollow shaft, said worm screw being actuated by a motor (38), said motor being provided with means for reversing the motion in the transversal direction.

3. The machine according to claim 1, wherein said arm (56) is provided with seats (60) shaped to receive the ends of said spindle (20).

4. The machine according to claim 1, which comprises two spindles, and transmission kinematic means to synchronize the rotation speed of the spindle being loaded with wound-on rolls ready to be removed and the spindle loaded with rolls on which said narrow strips of material have begun to wind.

5. The machine according to claim 1, which comprises a first set of cutting elements (76) of said wide strip (66) of material and a second set of cutting elements (82) of said wide strip, said first set and said second set of cutting elements being operated alternately when one of said sets is worn out.

6. The machine according to claim 5, wherein the cutting elements (76) of the first set and the cutting elements (82) of the second set are carried by supporting means (78) and (80) respectively, said supporting means (78) and (80) being supported by arms (78*a*) and (80*a*) respectively, connected to second revolving shafts (74) and (81) respectively.

7. The machine according to claim 6, wherein said cutting elements have supporting means, and said second revolving shafts supporting said supporting means are essentially parallel to each other and located on different axes.

8. The machine according to claim 7, wherein said supporting means (78) and (80) of the cutting elements of the wide strip (66) are supported by a removable cross-piece.

9. The machine according to claim 7, wherein the cutting elements (76) and (82) of the wide strip (66) of material can cut the strip on one of the external sides or on the internal side thereof.

10. The machine according to claim 9, which comprises piston means (83), said piston means locking said supporting means (80) and (78) of the cutting elements (82) and (76), said supporting means having a recess, said piston means having a shank, said shank having a projection (85), said piston means engaging with said supporting means (80) and (78) when said projection (85) is engaged in said recess.

11. The machine according to claim 1, wherein said cutting means comprise means for ejecting a wound-on roll (22) and starting a new roll on a core (44).

12. The machine according to claim 1, which comprises a feed station of the cores (44) provided with at least one essentially vertical duct (118) and ducts (116) to carry the cores (44) to said hollow shaft (36).

13. The machine according to claim 12, which comprises said at least one vertical duct (118) and the ducts (116) stop arms (120), means to stop said stop arms to feed one core at a time to said hollow shaft (36).

14. The machine according to claim 13, wherein said arms (120) are adjustable and programmable by means of automatic controls.

15. The machine according to claim 14, wherein said hollow shaft (36) is shaped in two separable portions (128) and (132) to receive and withhold the cores (44).

16. The machine according to claim 15, wherein to one of said portions (132) of said shaft (36) are associated sensors (140) to detect the presence of a core (44) and send a signal to detectors.

17. The machine according to claim 16 which comprises programmers for coordinated operation of the controls of the machine.

* * * * *